United States Patent [19]

Whipple

[11] 4,414,757

[45] Nov. 15, 1983

[54] WEB DRYER NOZZLE ASSEMBLY

[75] Inventor: Rodger E. Whipple, Neenah, Wis.

[73] Assignee: Overly, Incorporated, Neenah, Wis.

[21] Appl. No.: 309,267

[22] Filed: Oct. 7, 1981

[51] Int. Cl.[3] ..... F26B 13/20

[52] U.S. Cl. ..... 34/155; 34/156; 34/160; 226/97

[58] Field of Search ..... 34/155, 156, 160; 226/97, 7

[56] References Cited

U.S. PATENT DOCUMENTS

| | | | |
|---|---|---|---|
| 3,549,070 | 12/1970 | Frost et al. | 226/97 |
| 3,587,177 | 6/1971 | Overly | 34/156 |
| 3,711,960 | 1/1973 | Overly et al. | 34/156 |
| 3,763,571 | 10/1973 | Vits | 34/156 |
| 4,058,244 | 11/1977 | Vits . | |
| 4,074,841 | 2/1978 | Kramer et al. | 226/97 |
| 4,197,971 | 4/1980 | Stibbe | 34/156 |
| 4,247,993 | 2/1981 | Lindstrom | 34/160 |
| 4,308,984 | 1/1982 | Vits | 34/160 |
| 4,320,587 | 3/1982 | Vits | 226/97 |

*Primary Examiner*—Larry I. Schwartz

*Attorney, Agent, or Firm*—Andrus, Sceales, Starke & Sawall

[57] ABSTRACT

A web dryer has a plurality of nozzle assemblies. Each nozzle assembly is provided with a flat pressure plate adapted to form a gas flow zone with a moving web. A primary nozzle of the airfoil Coanda type is disposed at the upstream end of the pressure plate and continuously directs gas downstream along the face of the plate. A single secondary nozzle of the impingement type is disposed at the generally right angled downstream terminus of the pressure plate to continuously direct gas initially substantially perpendicularly to the web and to gas flowing downstream along the gas flow zone. The position of the secondary nozzle assures that the full width of the pressure plate is utilized. The gas flow volume through the secondary nozzle is less than half that of the primary nozzle. Furthermore, the gas flowing from the secondary or impingement nozzle turns to take the downstream direction of the main gas flow and also serves to cause compression of the main gas flow against the web downstream of the pressure plate and nozzle assembly terminus. An increase in the rate of heat transfer to the web is thus produced in the free area between adjacent nozzle assemblies. The compressive restriction of the main gas also tends to increase its unidirectional air flow velocity, which in turn isolates the web from the effects of miscellaneous gas flow currents within the enclosed dryer housing. The overall result is a slight back pressure or increase in static pressure in the gas flow zone which assists in keeping the moving web spaced from the pressure plate, but the back pressure is insufficient to reverse the direction of main gas flow.

6 Claims, 4 Drawing Figures

WEB DRYER NOZZLE ASSEMBLY

PRIOR ART OF INTEREST

| Pat. No. | Issued |
|---|---|
| U.S. Pat. No. 3,549,070 | December 22, 1970 |
| 3,711,960 | January 23, 1973 |
| 3,763,571 | October 9, 1973 |
| 4,058,244 | November 15, 1977 |
| 4,074,841 | February 21, 1978 |
| German 1,774,126 | February 8, 1973 |

BACKGROUND AND SUMMARY OF THE INVENTION

This invention relates to web dryers which are used in the manufacture of paper and the like and in the printing and coating of webs of paper, synthetic materials, film, etc.

Numerous types of web dryers have been developed over the years, with the dryers utilizing a variety of types of nozzle assemblies. Representative assemblies are disclosed in the above identified patents, many of which use the Coanda effect as described in detail in U.S. Pat. No. 3,549,070. This latter patent illustrates numerous assemblies having a pair of nozzles, some providing both a balanced and unbalanced Coanda characteristic when there is jet discharge into free space.

Other web dryer nozzle assemblies have been proposed which have a curved pressure plate, an upstream nozzle and a plurality of spaced downstream nozzles disposed intermediate the ends of the plate. See, for example, U.S. Pat. 3,763,571 and German Pat. No. 1,774,126.

Another type of construction is disclosed in U.S. Pat. No. 4,074,841 wherein nozzles are disposed at the upstream and downstream ends of a flat supporting plate, with the upstream nozzle creating high positive pressure in the zone between the plate and moving web. The downstream nozzle cooperates with a downstream extending diffuser sheet and functions in the manner of an airfoil to create a negative pressure in the zone between the diffuser sheet and the moving web. A spoiler, such as a hole or flange, is positioned intermediate the ends of the supporting plate.

In addition, it has been proposed in U.S. Pat. No. 3,711,960 to provide a plurality of nozzle assemblies arranged alternately on opposite sides of a moving web. In that patent, each assembly includes a single airfoil nozzle using the Coanda effect and with the nozzle assembly forming a sharp corner at the end of the support plate remote from the nozzle.

It is, of course, desirable to provide a maximum drying effect on the moving web. This cannot be accomplished if the zone between the pressure plate and web has substantially stagnant gas therein, or if the full available width of the pressure plate is not utilized. Neither can it be accomplished without minimizing the boundary layer of gas which travels along with the moving web. The effects of miscellaneous gas currents within the drying chamber on the web drying area must also be considered.

The present invention is directed to improved nozzle assemblies which are structured and cooperate with the moving web in such a manner that the above-mentioned factors are taken into account.

In accordance with various aspects of the invention, each nozzle assembly is provided with a flat pressure plate adapted to form a gas flow zone with a moving web. A primary nozzle of the airfoil Coanda type is disposed at the upstream end of the pressure plate and continuously directs gas downstream along the face of the plate. A single secondary nozzle of the impingement type is disposed at the generally right angled downstream terminus of the pressure plate to continuously direct gas initially substantially perpendicularly to the web and to gas flowing downstream along the gas flow zone. The position of the secondary nozzle assures that the full width of the pressure plate is utilized. The gas flow volume through the secondary nozzle is less than half that of the primary nozzle. Furthermore, the gas flowing from the secondary or impingement nozzle turns to take the downstream direction of the main gas flow and also serves to cause compression of the main gas flow against the web downstream of the pressure plate and nozzle assembly terminus. An increase in the rate of heat transfer to the web is thus produced in the free area between adjacent nozzle assemblies. The compressive restriction of the main gas also tends to increase its unidirectional air flow velocity, which in turn isolates the web from the effects of miscellaneous gas flow currents within the enclosed dryer housing. The overall result is a slight back pressure or increase in static pressure in the gas flow zone which assists in keeping the moving web spaced from the pressure plate, but the back pressure is insufficient to reverse the direction of main gas flow.

BRIEF DESCRIPTION OF THE DRAWINGS

The accompanying drawings illustrate the best mode presently contemplated by the inventor for carrying out the invention.

In the drawings.

DESCRIPTION OF THE PREFERRED EMBODIMENT

Figure 1:
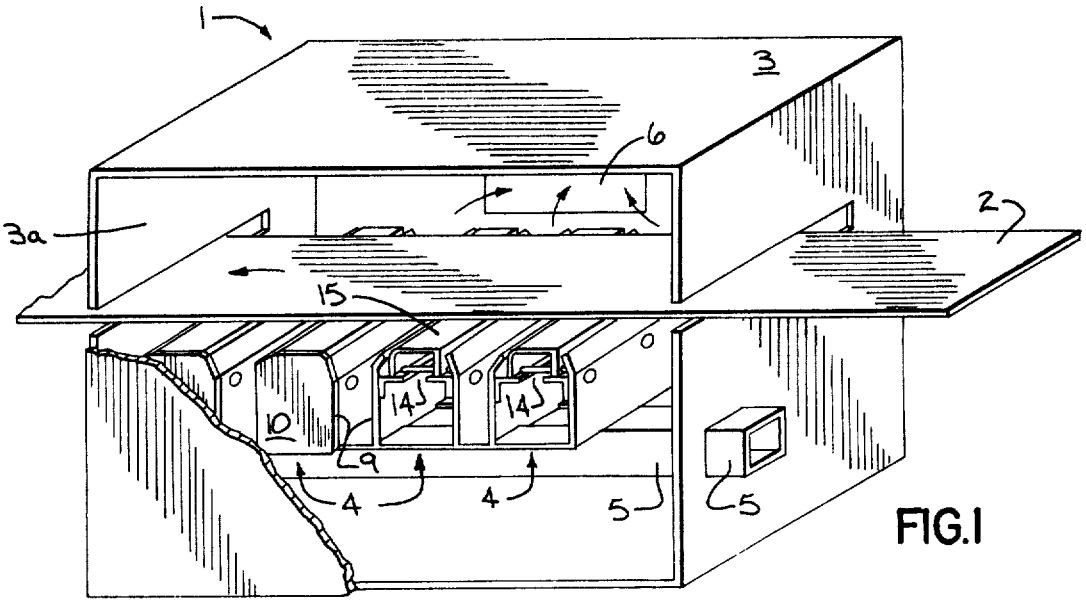
FIG. 1 is a perspective view with parts broken away showing a web passing through a web dryer which incorporates a plurality of nozzle assemblies constructed in accordance with the invention.

As shown in FIG. 1, a web dryer 1 is positioned for passthrough thereof of a fast moving flexible continuous web 2 of paper or other sheet material. Dryer 1 comprises a closed housing 3 forming a web drying chamber 3*a* having a plurality of spaced parallel nozzle assemblies 4 which extend transversely to the direction of web movement. Gas is continuously supplied under pressure from a suitable source, not shown, and through an inlet manifold supply pipe 5 to each assembly 4, is continuously discharged through assemblies 4 against web 2, and then passes over the web edges. The gas ultimately exits the chamber formed by housing 3, as through a passage 6. The gas flow velocity through assemblies 4 would be in the usual well-known range.

Figure 2:
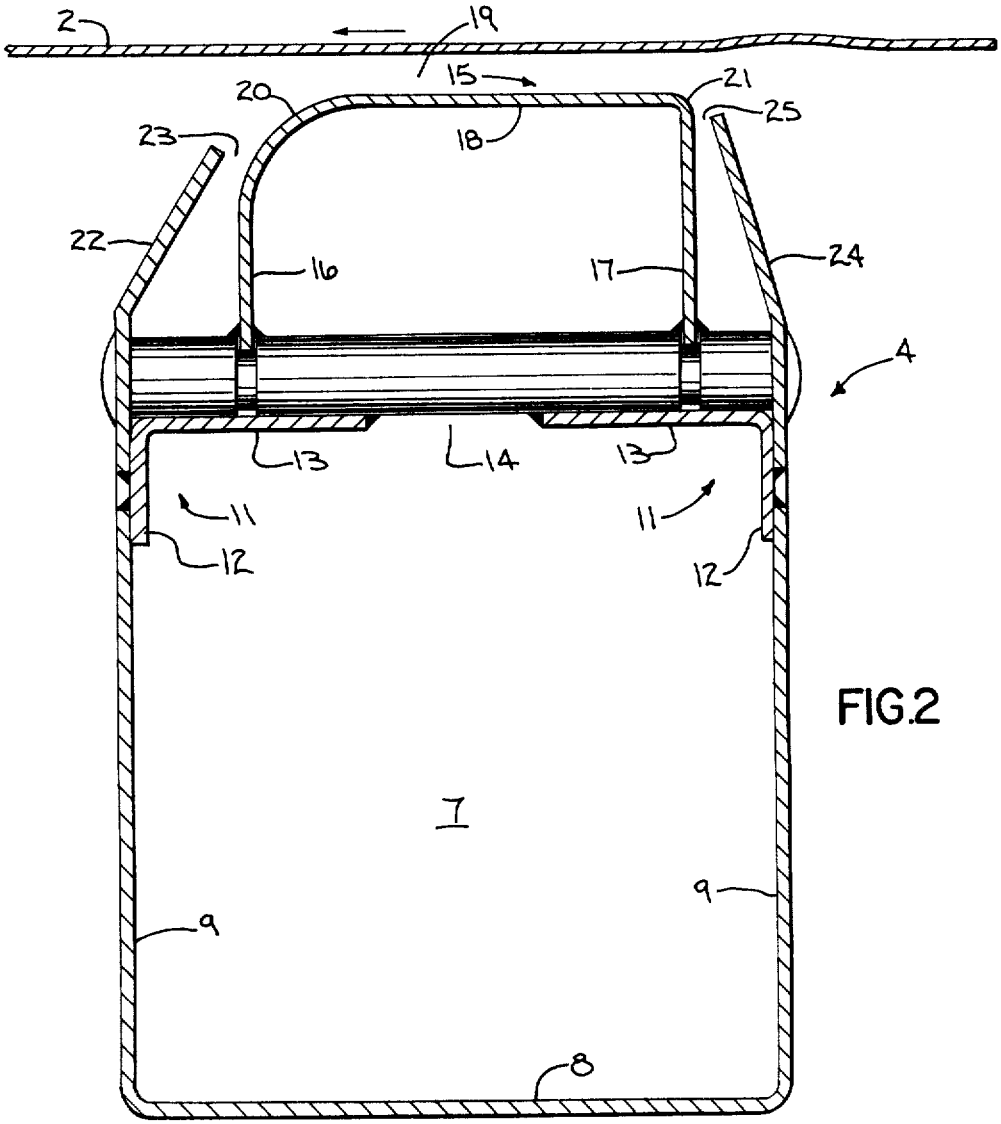
FIG. 2 is an enlarged central vertical section of a nozzle assembly.

Referring particularly of FIGS. 1 and 2, each nozzle assembly comprises an elongated plenum chamber 7 formed by a base plate 8, upstream and downstream vertical side plates 9, as well as end closure plates 10. The upper or innermost portion of plenum chamber 7 is defined by a pair of L-shaped angle members 11 having vertical legs 12 fixedly secured to side plates 9 and horizontal legs 13 which extend inwardly toward each other to form an elongated gas discharge slot 14 for the plenum.

A plate assembly 15 is suitably mounted between the outer wall of chamber 7 formed by legs 13 and web 2. Plate assembly 15 is generally U-shaped and comprises a vertical upstream wall 16, a vertical downstream wall 17 and a horizontal flat pressure plate 18 joining the walls. Pressure plate 18 is disposed in spaced parallelism from web 2 in the usual manner to form a gas flow zone 19 therebetween. The upstream corner 20 joining wall 16 and pressure plate 18 is substantially curved, and the downstream corner 21 joining wall 17 and pressure plate 18 is at a relatively sharp substantially right angle, for purposes to be described.

Nozzle assembly 4 is constructed to provide an airfoil type upstream nozzle utilizing the Coanda effect. For this purpose, upstream plenum side plate 9 is extended vertically beyond upstream leg 13 and merges into an inwardly inclined foil plate 22 whih terminates in spaced relationship with curved corner 20 to form a restrictive gas discharge slot-like primary nozzle 23. Due to the Coanda effect, gas continuously flowing through nozzle 23 tends to follow around curved corner 20 and be directed horizontally downstream through gas flow zone 19.

Nozzle assembly 4 is also constructed to provide only a single secondary gas discharge other than nozzle 23. This is formed by a single nozzle at the downstream terminus of assembly 4 and plate 18. This secondary nozzle, however, is not of the airfoil Coanda type, but instead functions as an impingement nozzle which continuously directs gas initially in a direction perpendicular to the gas flowing through zone 19. For this purpose, downstream plenum side plate 9 is also extended vertically beyond downstream leg 13 and merges into an inwardly inclined plate 24 which terminates just short of pressure plate 18 to form a restrictive gas discharge slot-like secondary nozzle 25.

It is contemplated that the gas flow volume passing through downstream secondary nozzle 25 is less than about half the gas flow volume passing through upstream primary nozzle 23. The optimum ratio of gas flow volumes has been found to be 3:8. One way of obtaining this desired result is to construct nozzles 25 and 23 so that their widths bear the ratio of 3:8, such as 0.03" to 0.08" respectively.

By locating secondary nozzle 25 at the downstream terminus of plate 18 which generally coincides with the terminus of assembly 4, the plate is utilized to its fullest extent over its entire width for purposes of maximum heat transfer gas flow drying of web 2.

Figure 3:
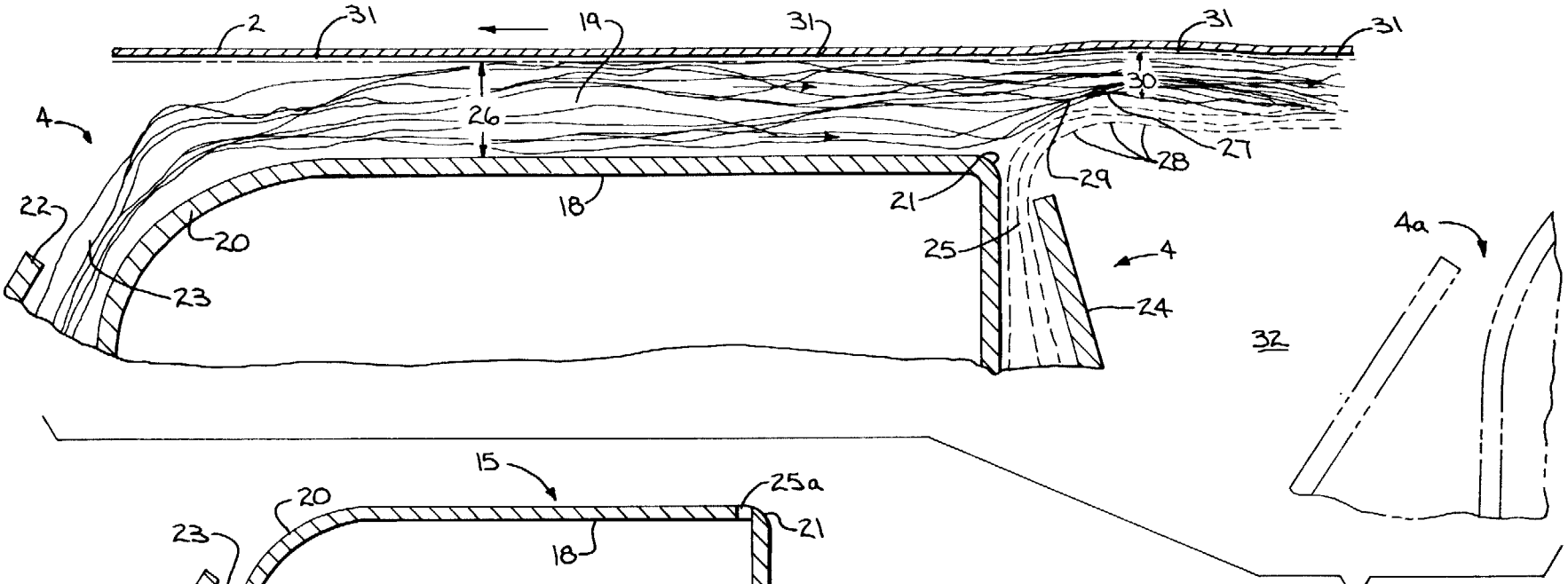
FIG. 3 is an enlarged fragmentary section of a nozzle assembly and showing the gas flow characteristics created thereby.

The gas flow characteristics of nozzle assembly 4 are shown in FIG. 3. The gas passing through upstream primary nozzle 23 follows around curved corner 20 and forms a unidirectionally flowing horizontal gas layer 26 between web 2 and the full width of pressure plate 18. The secondary gas passing vertically through downstream secondary nozzle 25 engages the flowing primary gas and then turns horizontally downstream before it reaches web 2. While the two streams of gas tend to merge along their interface 27, they remain generally separate and do not truly mix for some distance downstream of nozzle 25. Along interface 27, the flowing secondary gas 28 tends to cause the flowing primary gas 29 to be restricted in cross sectional thickness to less than the thickness of pad 26, as at 30, causing gas 29 to increase in velocity. The increased velocity of primary gas 29 disrupts and reduces the molecular thickness of the boundary layer 31 of gas (static gas always moving along with the web surface), thus increasing the rate of heat transfer between the horizontally unidirectionally flowing air and web 2. Drying efficiency is thus improved in the free area 32 between the terminus of one nozzle assembly 4 and the upstream edge portion of the next succeeding nozzle assembly 4*a*, area 32 being restricted in a vertical direction only by web 2, and with said area being free of restriction in a direction away from the web.

The use of a downstream impingement type nozzle 25 prevents dissipation of the gas flow directly beyond nozzle assembly 4, so that the area 32 increases drying efficiency rather than decreasing it.

The horizontally moving gas is finally dissipated by flowing over the edges of web 2 back into housing chamber 3*a* and hence through passage 6.

The ultimate result is the creation of a back pressure or increase in static pressure in gas flow zone 19. The pressure increase is accomplished with continuous unidirectional horizontal gas flow for the full width of pressure plate 18 and even downstream thereof. There will be no stagnant gas in gas flow zone 19. The compression of primary gas 29 in the area 30 contributes to the formation of the back pressure, and also isolates the web from the backup effects of undesirable miscellaneous superfluous gas flow currents which may be caused by gas remote from web 2 flowing through the housing chamber, and over manifold pipe 5 or the like, on its way to discharge passage 6. The back pressure which is created in zone 19 is insufficient to reverse the gas flow direction in the zone and at nozzles 23 and 25, but is sufficient to hold web 2 away from pressure plate 18.

Figure 4:
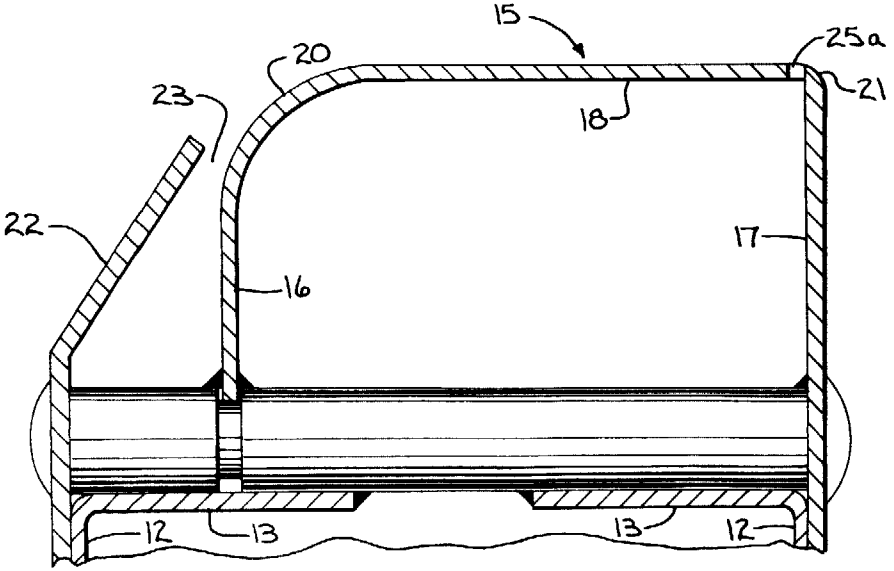
FIG. 4 is a fragmentary view of an alternative embodiment.

In some instances, the single secondary impingement nozzle may comprise a slot-like nozzle 25*a* disposed directly upstream of downstream wall 17 and in pressure plate 18, as shown in FIG. 4. This eliminates the need for plate 24, but is believed to be within the basic spirit of the invention.

While a row of nozzle assemblies 4 has been shown as disposed on only one side of web 2, it may be preferable to position a second row of assemblies on the opposite side of the web as well.

Various modes of carrying out the invention are contemplated as being within the scope of the following claims particularly pointing out and distinctly claiming the subject matter which is regarded as the invention.

I claim:

1. Apparatus for drying a moving flexible continuous web of material, said apparatus including a nozzle assembly comprising:

(a) a horizontally disposed flat pressure plate adapted to be positioned in spaced relation to the moving web, said pressure plate having an upstream end portion and a downstream terminus portion generally coinciding with the downstream terminus portion of the nozzle assembly, (b) a primary gas discharge Coanda nozzle disposed at said upstream end portion of said pressure plate and forming means for continuously directing primary gas unidirectionally and horizontally downstream through a gas flow zone between said plate and the moving web, (c) a single secondary gas discharge nozzle disposed at the downstream terminus of said pressure plate, said secondary nozzle being of the impingement type and forming means for continuously directing secondary gas toward said web and into merging but generally separate interface relationship with said primary gas at a location downstream of said pressure plate terminus, (d) said impingement type secondary gas discharge nozzle cooperating with the web at said downstream location to form means for increasing the static pressure in said unidirectionally flowing primary gas in said gas flow zone for the full width of said pressure plate, (e) said secondary gas discharge nozzle being formed by a pair of plates disposed at the said downstream terminus of said pressure plate, with one of said pair of plates being generally vertically oriented and the other of said pair of plates being inclined from the vertical, (f) said pair of plates converging to form a discharge slot forming means for directing gas generally perpendicularly to said pressure plate.

2. The apparatus of claim 1 wherein:

(a) said vertically oriented plate of said pair of plates forms a relatively sharp right angled corner with the downstream terminus of said pressure plate, (b) and the other of said pair of plates is spaced downstrem of and inclined upstream toward said vertically oriented plate.

3. The apparatus of claim 2 wherein said inclined plate terminates below said pressure plate.

4. The apparatus of claim 1 wherein said impingement type secondary gas discharge nozzle directs secondary gas in a manner to form means along said interface to restrictively compress said flowing primary gas against the moving web to thereby increase the velocity of said primary gas at said location.

5. The apparatus of claim 4 wherein said restrictively compressing means forms means to decrease the boundary layer of static gas moving with the web to thereby increase the rate of heat transfer between the web and horizontally moving gas at said location.

6. The apparatus of claim 4 or 5:

(a) which includes a generally closed housing forming a web drying chamber within which said moving web and nozzle assembly are disposed, said chamber having gas inlet means therein and being connected to a gas discharge outlet, (b) and wherein said restrictively compressing means forms means to isolate the moving web in said gas flow zone from the effects of gas currents within said drying chamber remote from said zone.

* * * * *